US007533551B1

(12) United States Patent
Liu

(10) Patent No.: US 7,533,551 B1
(45) Date of Patent: May 19, 2009

(54) DOOR LOCK WITH KEY CYLINDER

(76) Inventor: Ming-I Liu, No. 18, Alley 3, Lane 315, Sec. 2, Jhonghua S. Rd., Tainan (TW)

( * ) Notice: Subject to any disclaimer, the term of this patent is extended or adjusted under 35 U.S.C. 154(b) by 0 days.

(21) Appl. No.: 12/040,982

(22) Filed: Mar. 3, 2008

(51) Int. Cl.
*E05B 9/08* (2006.01)

(52) U.S. Cl. ..... 70/370; 70/107; 70/134

(58) Field of Classification Search ..... 70/107, 70/134, 367–371, 451, 466
See application file for complete search history.

(56) References Cited

U.S. PATENT DOCUMENTS

| | | | | | |
|---|---|---|---|---|---|
| 180,287 | A | | 7/1876 | Towne | |
| 373,253 | A | * | 11/1887 | Taylor | 70/370 |
| 380,537 | A | * | 4/1888 | Taylor | 70/370 |
| 391,826 | A | * | 10/1888 | Taylor | 70/370 |
| 399,141 | A | * | 3/1889 | Fiske | 70/107 |
| 416,467 | A | * | 12/1889 | Lincoln | 70/134 |
| 624,411 | A | * | 5/1899 | Voight | 70/370 |
| 655,145 | A | * | 7/1900 | Adams | 70/370 |
| 659,483 | A | * | 10/1900 | Lockwood | 70/370 |
| 659,484 | A | * | 10/1900 | Lockwood | 70/370 |
| 743,695 | A | * | 11/1903 | Dimock | 70/107 |
| 777,130 | A | * | 12/1904 | Noack | 70/370 |
| 966,970 | A | * | 8/1910 | Weed | 70/134 |
| 971,333 | A | * | 9/1910 | Weed | 70/370 |
| 1,122,862 | A | * | 12/1914 | Cleaver | 70/370 |
| 1,243,016 | A | | 10/1917 | Voight | |
| 1,272,915 | A | * | 7/1918 | Cleaver | 70/107 |
| 1,446,632 | A | | 2/1923 | Bacon | |
| 1,684,230 | A | * | 9/1928 | Lach | 70/370 |
| 1,744,167 | A | * | 1/1930 | Keil | 70/370 |
| 1,894,177 | A | * | 1/1933 | Johnston | 70/370 |
| 2,320,177 | A | | 5/1943 | Golden et al. | |
| 2,549,724 | A | | 4/1951 | Tinnerman | |
| 3,266,276 | A | * | 8/1966 | Yulkowski | 70/110 |
| 3,745,795 | A | | 7/1973 | Sanders | |
| 3,769,822 | A | * | 11/1973 | Yulkowski | 70/107 |
| 4,539,828 | A | | 9/1985 | Teleky | |
| 4,683,736 | A | | 8/1987 | Weinerman et al. | |
| 5,044,184 | A | * | 9/1991 | Herbers et al. | 70/277 |
| 5,577,408 | A | | 11/1996 | Roos | |

(Continued)

FOREIGN PATENT DOCUMENTS

| | | |
|---|---|---|
| JP | 1299968 | 12/1989 |

*Primary Examiner*—Suzanne D Barrett
(74) *Attorney, Agent, or Firm*—Alan Kamrath; Kamrath & Associates PA

(57) ABSTRACT

A door lock includes a case, a deadbolt mounted in the case, and a key cylinder mounted in the case. The key cylinder includes a lock core operable to retract the deadbolt from an extended, locking position to a retracted, unlocking position. A positioning device is mounted in the case for retaining the key cylinder in place. The case includes two opposite lateral sides each having a key cylinder-receiving hole. The key cylinder is optionally mounted in one of the key cylinder-receiving holes from either of opposite lateral orientations in the case and includes at least one longitudinal groove formed in an outer circumference thereof. The positioning device includes a retainer slideable between the two lateral sides of the case and an operative member operable to move the retainer between a retaining position engaged with the at least one longitudinal groove of the key cylinder and a releasing position disengaged from the key cylinder.

7 Claims, 5 Drawing Sheets

U.S. PATENT DOCUMENTS

| | | | | |
|---|---|---|---|---|
| 5,622,065 | A | 4/1997 | Persiano | |
| 6,354,121 | B1 * | 3/2002 | Frolov | 70/277 |
| 6,557,909 | B2 * | 5/2003 | Morris | 292/169.15 |
| 6,564,603 | B1 | 5/2003 | O'Neill | |
| 6,981,726 | B2 | 1/2006 | Huang | |
| 6,993,946 | B1 * | 2/2006 | Shen | 70/472 |
| 2002/0026817 | A1 | 3/2002 | Greer | |
| 2003/0019257 | A1 | 1/2003 | Simon et al. | |
| 2005/0011239 | A1 | 1/2005 | Lurie et al. | |
| 2005/0223764 | A1 | 10/2005 | Pierson et al. | |
| 2007/0240465 | A1 | 10/2007 | Clifford et al. | |

* cited by examiner

DOOR LOCK WITH KEY CYLINDER

BACKGROUND OF THE INVENTION

1. Field of Invention

The present invention relates to a door lock and, more particularly, to a mortise lock including a key cylinder retained therein by a positioning device.

2. Related Prior Art

A typical mortise lock includes a deadbolt and a latch bolt both mounted in a case for locking a door to which the lock is mounted. A key cylinder is installed in the case, and the deadbolt is generally moved to its retracted position by operation of the key cylinder with a key or by turning a turnknob mounted to an inner side of the door. However, retention and replacement of the key cylinder are troublesome.

A need exists for a door lock with a key cylinder that can be securely retained and easily assembled and replaced.

SUMMARY OF THE INVENTION

An objective of the present invention is to provide a door lock with a positioning device to allow easy and secure retention of a key cylinder mounted in the door lock.

A door lock in accordance with the present invention includes a case adapted to be mounted in a door, a deadbolt mounted in the case, and a key cylinder mounted in the case. The key cylinder includes a lock core operable to retract the deadbolt from an extended, locking position outside the case to a retracted, unlocking position inside the case. A positioning device is mounted in the case for retaining the key cylinder in place. The case includes two opposite lateral sides each having a key cylinder-receiving hole. The key cylinder is optionally mounted in one of the key cylinder-receiving holes from either of opposite lateral orientations in the case and includes at least one longitudinal groove formed in an outer circumference thereof. The positioning device includes a retainer slideable between the two lateral sides of the case and an operative member operable to move the retainer between a retaining position engaged with the longitudinal groove of the key cylinder and a releasing position disengaged from the key cylinder.

Preferably, the two lateral sides of the case include two aligned first sliding slots each of which is in communication with an associated key cylinder-receiving hole and further include two aligned second sliding slots and two aligned anchor holes. The retainer includes a first end, a second end, and two lateral sides. A stop is provided on each lateral side of the first end of the retainer and is slideably received in an associated first sliding slot in the case. A protrusion is provided on each lateral side of the retainer adjacent the second end of the retainer and is slideably received in an associated second sliding slot in the case, allowing the retainer to move between the two lateral sides of the case.

Preferably, the first and second sliding slots and the anchor hole of each lateral side of the case are aligned and extend in a direction parallel to the moving direction of the deadbolt.

Preferably, the front end of the stop is arrow-shaped and has two inclined opposite faces meeting at a point such that the front end of the stop is engageable with the longitudinal groove of the key cylinder.

In an embodiment, the positioning device further includes a guide seat mounted in the case. The guide seat includes two lateral sides and a screw hole extending between the two lateral sides in a direction parallel to the moving direction of the deadbolt. A protrusion is provided on each lateral side of the guide seat and is inserted into one of the two anchor holes in the lateral sides of the case. The operative member includes a first end, a second end and a threaded section between the first end and the second end for threadedly engaging with the screw hole of the guide seat.

Preferably, the retainer includes a recess formed in the second end thereof and further includes a coupling notch in communication with the recess via an opening. The first end of the operative member is engaged in the coupling notch of the retainer, and a neck portion is formed adjacent the first end of the operative member for engaging with the opening of the retainer.

Preferably, the second end of the operative member is formed with a slot for manual operation.

In an embodiment, the case further includes an outer end face to which at least one faceplate is attached, and a through-hole aligned with the operative member is provided in the faceplate such that a screw-driving tool can be extended into the through-hole to drive the operative member.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight strength, and similar requirements will likewise be within the skill of the art after the following teachings of the present invention have been read and understood.

DETAILED DESCRIPTION OF THE INVENTION

Figure 1:
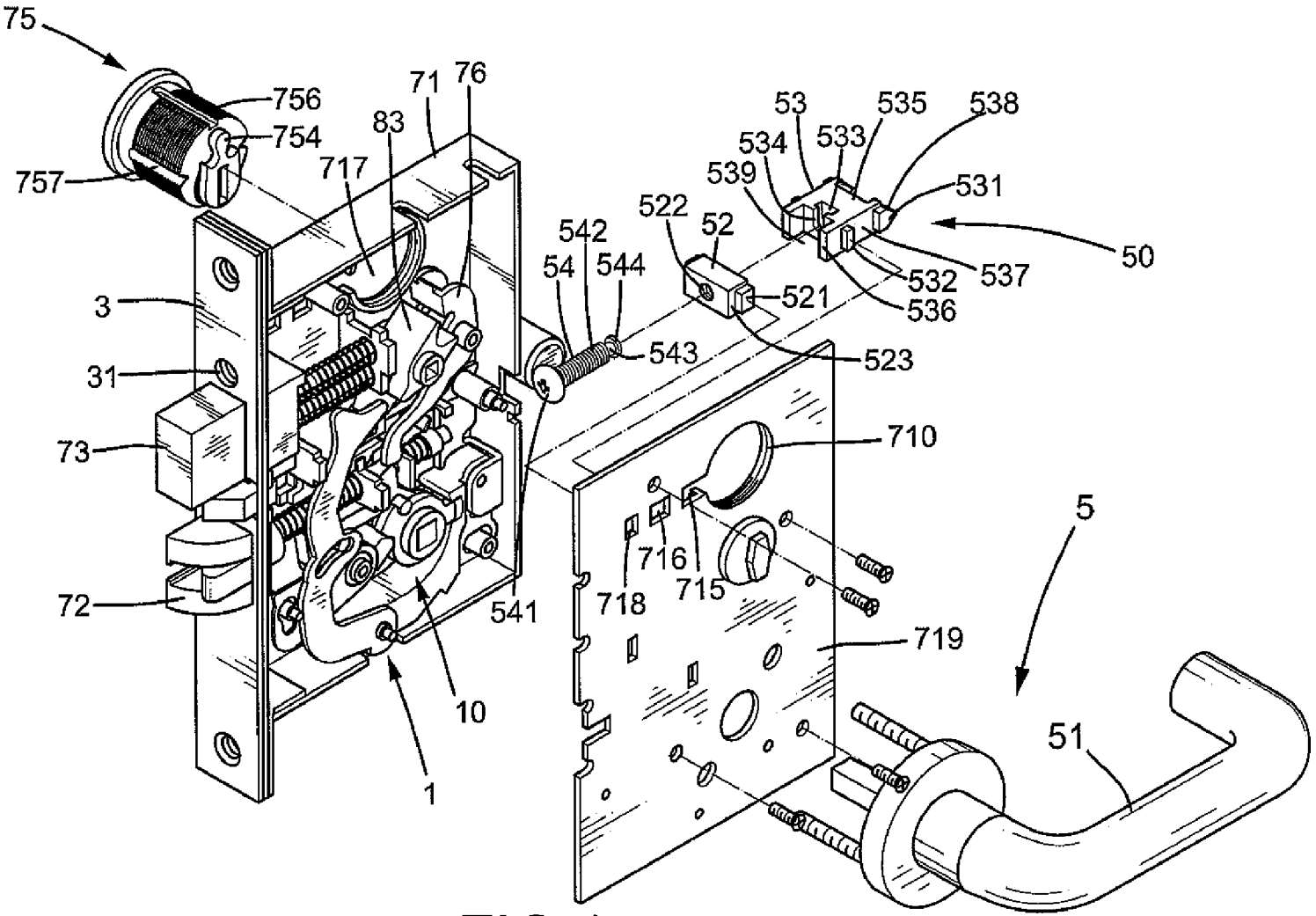
FIG. 1 shows a diagrammatic exploded perspective view of a door lock according to the preferred teachings of the present invention.
Figure 2:
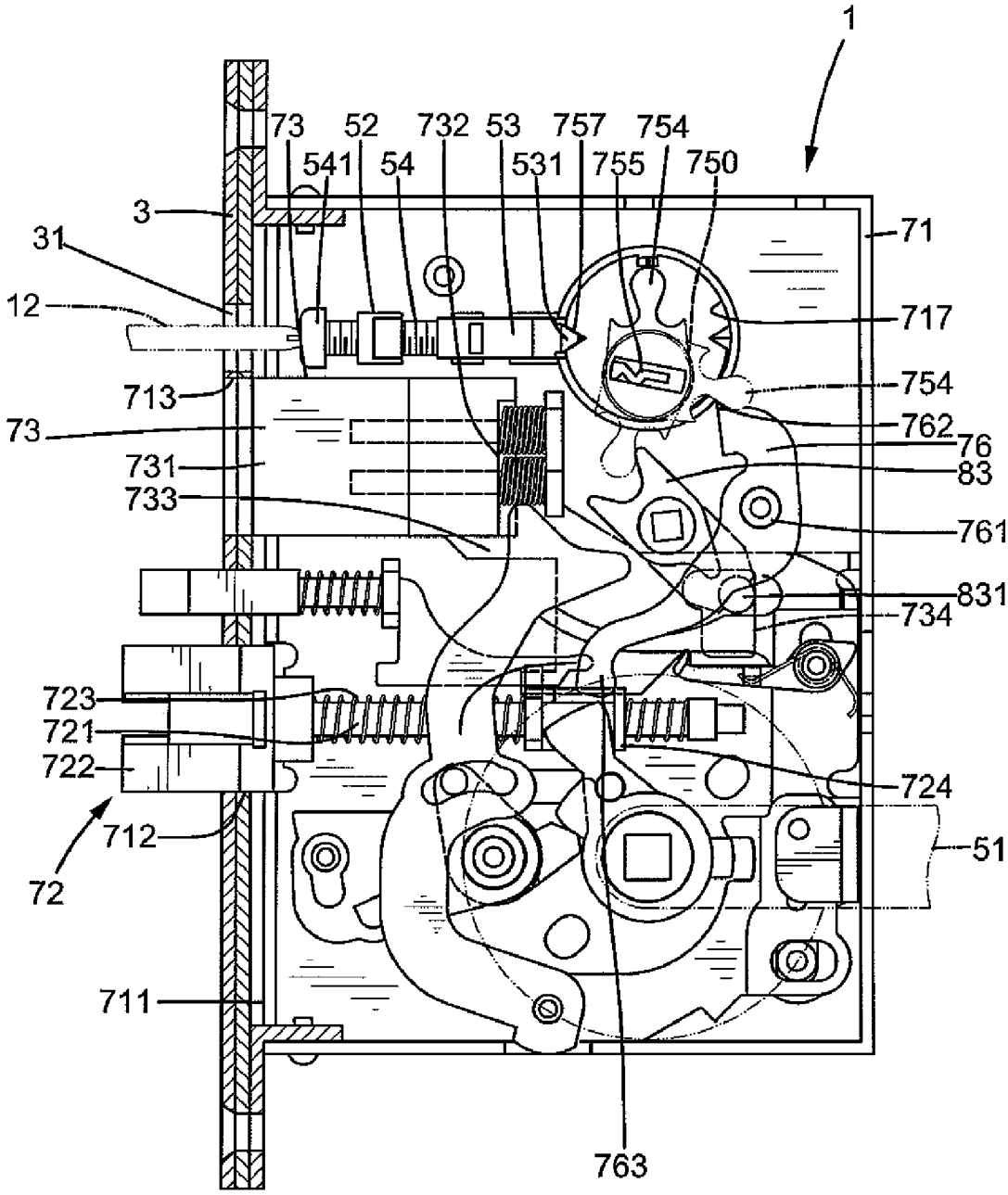
FIG. 2 shows a cross sectional view of the door lock of FIG. 1 after assembly, with a positioning device in a retaining position engaged with a key cylinder
Figure 3:
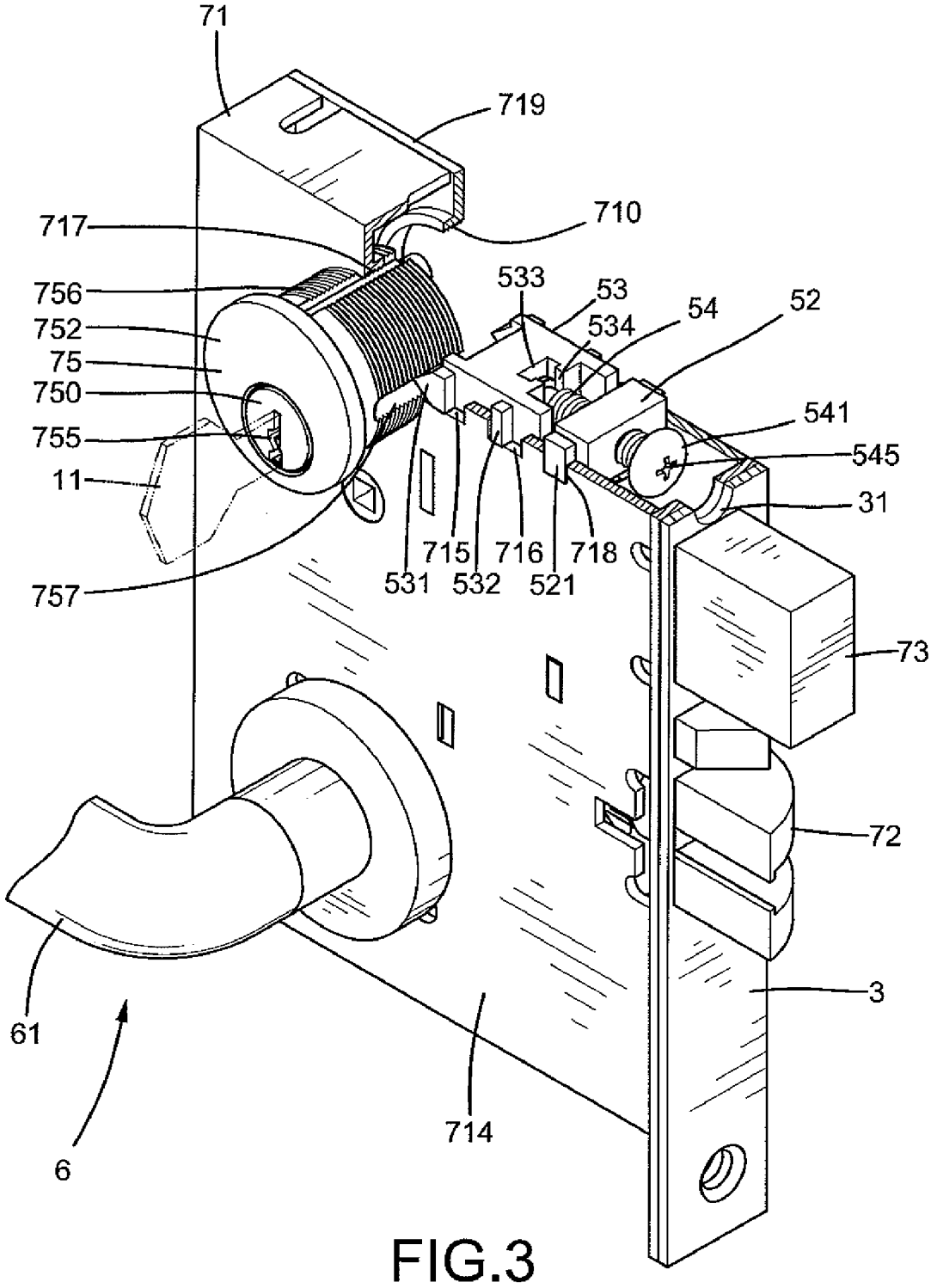
FIG. 3 shows a perspective view, partly cutaway, of the door lock of FIG. 1 after assembly, with the key cylinder mounted in a key cylinder-receiving hole in a lateral side of the case of the door lock.

Referring to FIGS. 1 through 3, a door lock according to the preferred teachings of the present invention is shown in the drawings and generally designated 1. The door lock 1 is shown as a mortise lock mounted in a door (not shown).

According to the preferred form shown, the door lock 1 includes a substantially parallelepiped case 71 receiving a latch bolt 72, a deadbolt 73, and a key cylinder 75. An inside handle assembly 5 including an inside handle 51 and an outside handle assembly 6 including an outside handle 61 are assembled together and are respectively fixed to two sides of the case 71. The inside handle 51 and the outside handle 61 are respectively operable to retract the latch bolt 72 from an extended position to a retracted position through a conventional actuating mechanism 10.

The case 71 includes an outer end face 711 to which two faceplates 3 are attached. The faceplates 3 can be deemed as a part of the case 71. Two openings 712 and 713 extend through the outer end face 711 and the faceplates 3. The case 71 further includes a key cylinder-receiving hole 717 in a lateral side 714 thereof. A lid 719 is mounted to an open side of the case 71 and forms a second lateral side opposite to the lateral side 714 of the case 71. A key cylinder-receiving hole 710 is formed in the lid 719 and is aligned with the key cylinder-receiving hole 717 of the lateral side 714. Each key cylinder-receiving hole 717, 710 includes inner threading.

The key cylinder 75 includes a hollow body 752 receiving a lock core 750. The lock core 750 includes an actuating member 754 on an inner end thereof and a keyway 755. Outer threading 756 is formed on an outer circumference of the hollow body 752, allowing the key cylinder 75 to be threadedly coupled in either the key cylinder-receiving hole 717 in the lateral side 714 or the key cylinder-receiving hole 710 in the lid (the second lateral side) 719. This will permit the door lock 1 to suit differently handed doors by optionally mounting the key cylinder 75 in either the key cylinder-receiving hole 717 or the key cylinder-receiving hole 710 from either of opposite lateral orientations in the case 71.

The latch bolt 72 includes a head 722 and a shank 721 extending from the head 722 through the opening 712 into the case 71. The head 722 of the latch bolt 72 includes triangular cross sections and is normally biased by a spring 723 to an extended, latching position outside the case 71. A substantially U-shaped bracket 724 is mounted on the shank 721 and is drivable by a lever link 76 to move the latch bolt 72 between the extended, latching position and a retracted, unlatching position in the case 71 (not shown). The lever link 76 is mounted in the case 71 and includes an intermediate portion pivotably mounted around a pivot 761 formed on an inner face of the lateral side 714. The lever link 76 further includes a first end 762 and a second end 763 engaged with the bracket 724 of the latch bolt 72. Furthermore, the lever link 76 can be driven by the actuating member 754 of the lock core 750. Specifically, when a key 11 is inserted into the keyway 755 of the lock core 750 and turned, the actuating member 754 is rotated clockwise to move the latch bolt 72 inward to its retracted, unlatching position.

The deadbolt 73 is in the form of a parallelepiped and includes an outer end 731 extendible through the opening 713 between an extended, locking position outside the case 71 and a retracted, unlocking position inside the case 71. The deadbolt 73 further includes an inner end 732 from which a connecting plate 733 extends. The connecting plate 733 includes a slot 734 through which an actuating portion 831 of a pivotal member 83 extends. When the deadbolt 73 is in its locking position, with insertion of the key 11 into the keyway 755 of the lock core 750, and with turning of the key 11, the actuating member 754 pushes the pivotal member 83 to turn such that the deadbolt 73 is moved inward to its retracted, unlocking position. Thus, unlocking the deadbolt 73 from the outer side of the door to which the door lock 1 is mounted can be attained by operation of the key cylinder 75.

The above structure and operations are conventional. The present invention is characterized in that a positioning device 50 is mounted in the case 71 for securely retaining the key cylinder 75 in place. In the preferred embodiment of the invention, the positioning device 50 generally includes a retainer 53, a guide seat 52, and an operative member 54. Furthermore, to provide for retention of the key cylinder 75 by the positioning device 50, at least a longitudinal groove 757 is formed in the outer circumference of the hollow body 752. In this illustrated embodiment, the outer circumference of the hollow body 752 is formed with two diametrically opposite longitudinal grooves 757. Moreover, to provide engagement of the positioning device 50 with the case 71, the two lateral sides 714 and 719 of the case 71 further include aligned first sliding slots 715 each of which is in communication with an associated key cylinder-receiving hole 710 or 717, aligned second sliding slots 716, and aligned anchor holes 718. The first and second sliding slots 715, 716 and the anchor hole 718 of each of the lateral side 714 and the lid (the second lateral side) 719 are spaced from one another. The first and second sliding slots 715, 716 and the anchor hole 718 of each of the lateral side 714 and the lid (the second lateral side) 719 are aligned and extend in a direction parallel to the moving direction of the deadbolt 73.

Referring to FIGS. 1 and 3, the retainer 53 includes a first end 535, a second end 536, and two lateral sides 537. A stop 531 is provided on each lateral side 537 of the first end 535 of the retainer 53 and is slideably received in an associated first sliding slot 715 in the case 71. A protrusion 532 is provided on each lateral side 537 adjacent the second end 536 of the retainer 53 and is slideably received in an associated second sliding slot 716 in the case 71. Thus, the retainer 53 moves between the two lateral sides 714 and 719 of the case 71. Each stop 531 includes at least one inclined face 538 on a front end thereof. In the preferred form shown, the front end of the stop 531 is arrow-shaped and has two inclined opposite faces 538 meeting at a point such that the front end of the stop 531 can be engaged with the longitudinal groove 757 of the key cylinder 75 (FIG. 2). Further, the retainer 53 includes a recess 539 formed in the second end 536 and includes a coupling notch 533 in communication with the recess 539 via an opening 534.

The guide seat 52 includes two lateral sides 523 and a screw hole 522 extending between the two lateral sides 523 in a direction parallel to the moving direction of the deadbolt 73. A protrusion 521 is provided on each lateral side 523 of the guide seat 52 and engaged with an associated anchor hole 718 in the lateral sides 714 and 719 of the case 71.

The operative member 54 includes a first end 544, a second end 541 and a threaded section 542 between the first end 544 and the second end 541 for threadedly engaging with the screw hole 522 of the guide seat 52. The first end 544 is extended into the recess 539 of the second end 536 of the retainer 53 and engaged in the coupling notch 533 of the retainer 53, and a neck portion 543 is formed adjacent the first end 544 for engaging with the opening 534 of the retainer 53. Thus, the retainer 53 moves together with the operative member 54 when the operative member 54 has rotational movement relative to the guide seat 52.

The operative member 54 is a screw in the illustrated embodiment. The second end 541 is a head of the screw and is formed with a slot 545 for tool operation. In the most preferred form, a through-hole 31 aligned with the operative member 54 is provided in the faceplates 3 such that a screwdriving tool 12 can be extended through the through-hole 31 and inserted into the slot 545 of the operative member 54 to drive the operative member 54 in order to move the retainer 53 in the moving direction of the deadbolt 73.

Figure 4:
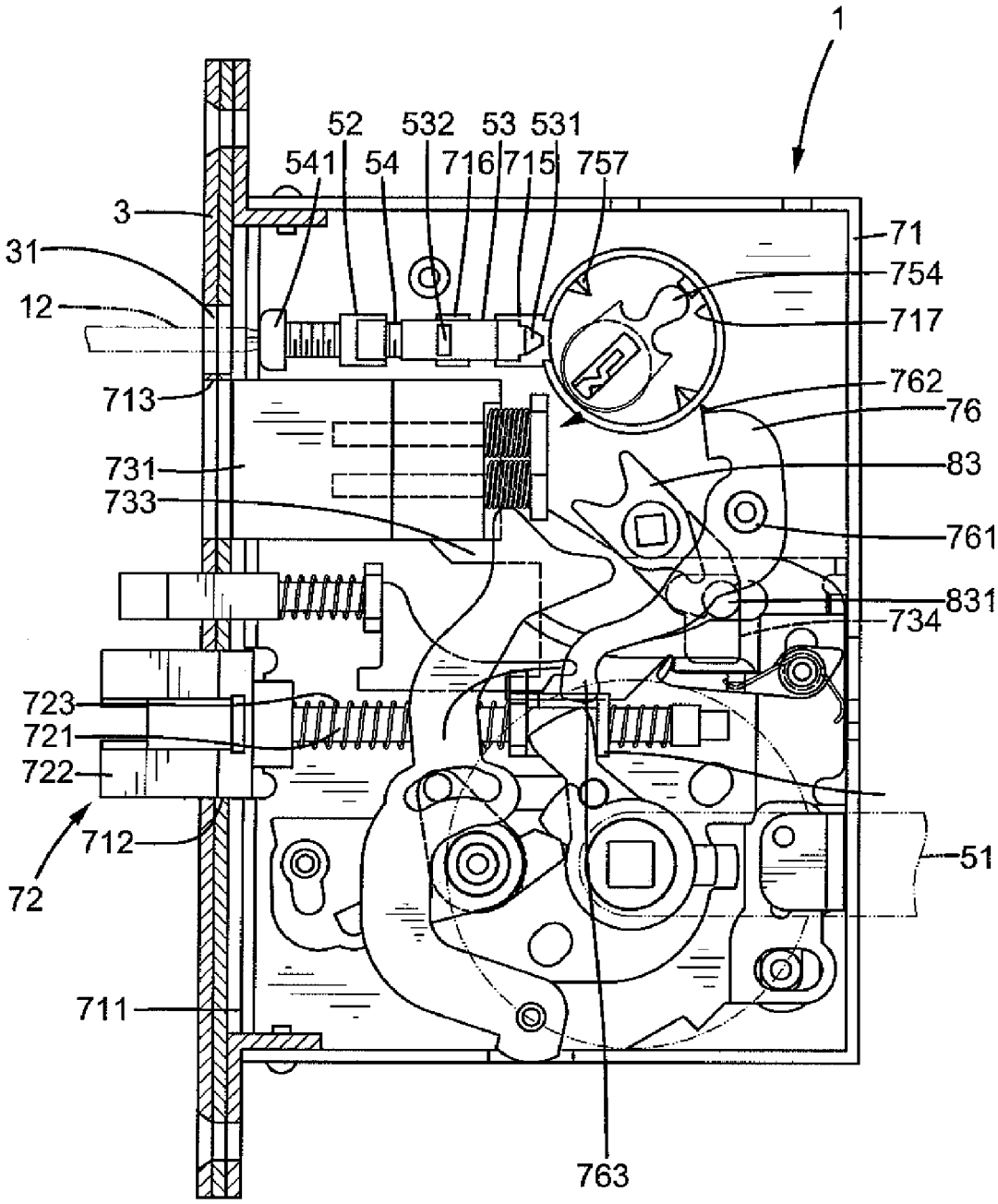
FIG. 4 shows a cross sectional view of the door lock of FIG. 1 after assembly, with the positioning device in a withdrawing position disengaged from the key cylinder.

In installation, as discussed above and as shown in FIGS. 3 and 5, the key cylinder 75 is optionally mounted in the key cylinder-receiving hole 717 in the lateral side 714 or the key cylinder-receiving hole 710 in the lid 719 from either of opposite lateral orientations in the case 71 to suit doors of different hands. First, referring to FIGS. 3 and 4, when the key cylinder 75 is threadedly mounted in the key cylinder-receiving hole 717 from a first lateral orientation in the case 71, an installer needs only to adjust one of the longitudinal grooves 757 of the hollow body 752 to align with the first end 535 of the retainer 53 and, then, drives the operative member 54 by the screw-driving tool 12 to move the first end 535 of the retainer 53 into the key cylinder-receiving hole 717 as shown in FIG. 2. Thus, the front end of the stop 531 in the lateral side 714 is engaged in the longitudinal groove 757 of the hollow body 752, retaining the key cylinder 75 in place. To retract the key cylinder 75 from its mounting position, the operative member 54 can be rotated by the screw-driving tool 12 in a reverse direction to move the first end 535 of the retainer 53 out of the key cylinder-receiving hole 717 as shown in FIG. 4. Then, the key cylinder 75 can be removed and replaced.

Figure 5:
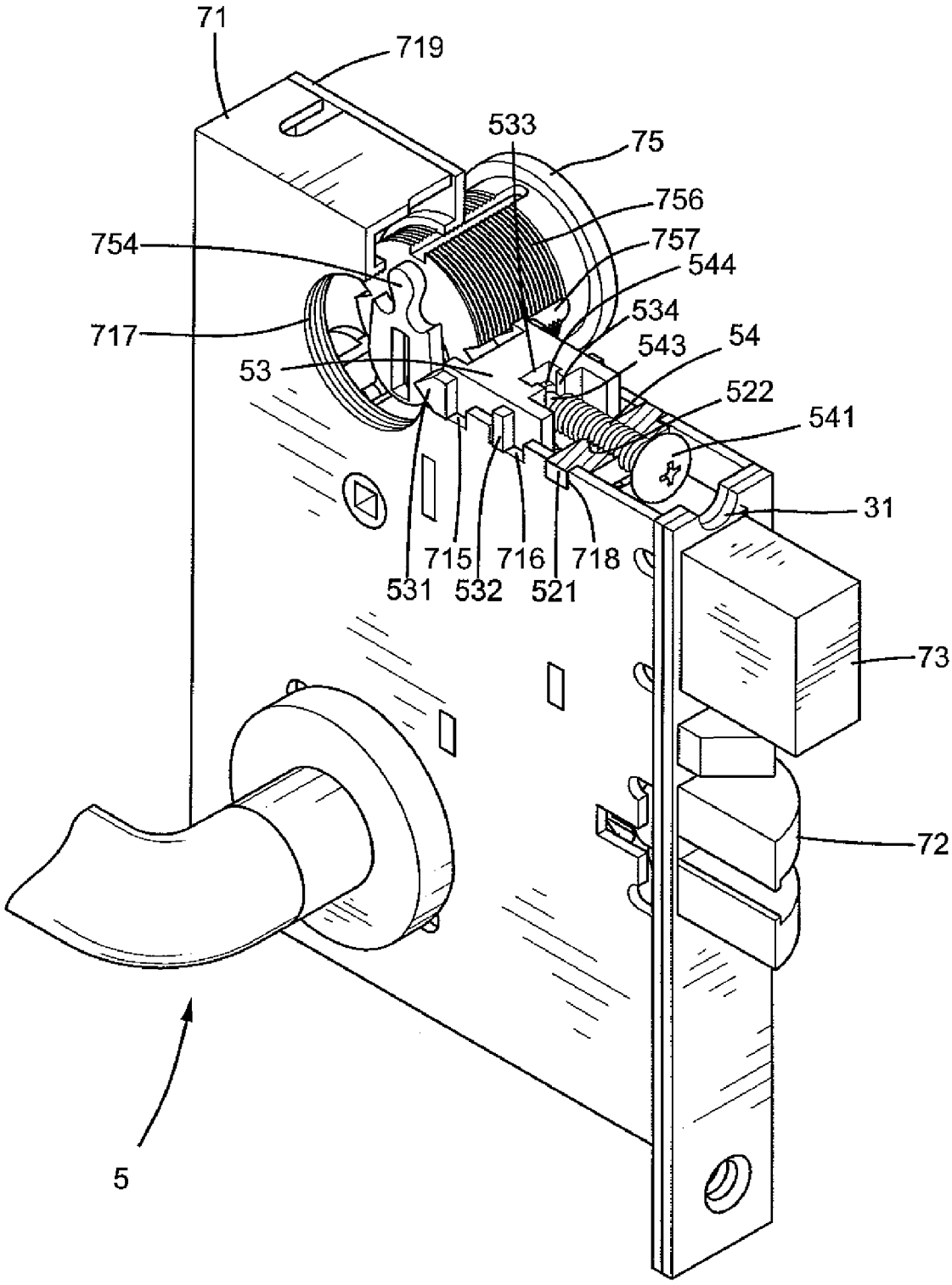
FIG. 5 shows a perspective view, partly cutaway, of the door lock of FIG. 1 after assembly, with the key cylinder mounted in a key cylinder-receiving hole in a lid of the case of the door lock.

Further, referring to FIG. 5, when the key cylinder 75 is threadedly mounted in the key cylinder-receiving hole 710 from a second lateral orientation in the case 71, the installer also needs only to adjust one of the longitudinal grooves 757 of the hollow body 752 to align with the first end 535 of the retainer 53 and, then, drives the operative member 54 to move the first end 535 of the retainer 53 into the key cylinder-receiving hole 710 as shown in FIG. 5. Thus, the front end of the stop 531 in the lid (the second lateral side) 719 is engaged in the longitudinal groove 757 of the key cylinder 75 to prevent retraction of the key cylinder 75 from the case 71.

The operation of the positioning device 50 in accordance with the present invention is easy and, thus, allows easier retention and retraction of the key cylinder 75. Retention or positioning of the key cylinder 75 is reliable by the engagement of the front ends of the stops 531 with the longitudinal grooves 757. Nevertheless, the present invention is not limited to the arrangement of the inclined faces 538 of the front ends of the stops 531 shown in the figures.

The present invention has been described via the detailed illustration of the embodiments. Those skilled in the art can derive variations from the embodiments without departing from the scope of the present invention. Therefore, the embodiments shall not limit the scope of the present invention defined in the claims

What is claimed is:

1. A door lock comprising:

a case adapted to be mounted in a door and including two opposite lateral sides each having a key cylinder-receiving hole;

a deadbolt mounted in the case and movable between an extended, locking position outside the case and a retracted, unlocking position inside the case;

a key cylinder mounted in the case and including a hollow body receiving a lock core operable to retract the deadbolt from the extended position to the retracted position, with the hollow body including at least one longitudinal groove formed in an outer circumference thereof; and a positioning device mounted in the case and including a retainer slideable between the two lateral sides of the case and an operative member operable to move the retainer between a retaining position engaged with said at least one longitudinal groove of the key cylinder and a releasing position disengaged from the key cylinder, with the two lateral sides of the case further including two aligned first sliding slots each of which is in communication with an associated key cylinder-receiving hole, two aligned second sliding slots and two aligned anchor holes, with the retainer including a first end, a second end, and two lateral sides, with a stop being provided on each of the two lateral sides of the first end of the retainer and slideably received in one of the two first sliding slots in the case, with a protrusion being provided on each of the two lateral sides of the retainer adjacent the second end of the retainer and slideably received in one of the two second sliding slots in the case.

2. The door lock according to claim 1, wherein the first and second sliding slots and the anchor hole of each of the two lateral sides of the case are aligned and extended in a direction parallel to a moving direction of the deadbolt.

3. The door lock according to claim 1, with a front end of the stop being arrow-shaped and having two inclined opposite faces meeting at a point, and with the front end of the stop being engageable with the at least one longitudinal groove of the key cylinder.

4. The door lock according to claim 1, with the positioning device further including a guide seat mounted in the case, with the guide seat including two lateral sides and a screw hole extending between the two lateral sides of the guide seat in a direction parallel to the moving direction of the deadbolt, and with a protrusion being provided on each of the two lateral sides of the guide seat and inserted into one of the anchor holes of the two lateral sides of the case.

5. The door lock according to claim 4, wherein the operative member includes a first end, a second end and a threaded section between the first end and the second end of the operative member and threadedly engaged with the screw hole of the guide seat.

6. The door lock according to claim 4, with the retainer further including a recess formed in the second end thereof and a coupling notch in communication with the recess via an opening, with the first end of the operative member being engaged in the coupling notch of the retainer, and with a neck portion being formed adjacent the first end of the operative member and engaged with the opening of the retainer.

7. The door lock according to claim 4, with the second end of the operative member including a slot, with the case further including an outer end face, with a faceplate being attached to the outer end face and including a through-hole aligned with the operative member, and with a screw-driving tool being adapted to be extended through the through-hole and inserted into the slot to drive the operative member.

* * * * *